United States Patent [19]

Hamaker

[11] 4,119,307

[45] Oct. 10, 1978

[54] SHEET STRIPPING APPARATUS

[75] Inventor: Ralph A. Hamaker, Penfield, N.Y.

[73] Assignee: Xerox Corporation, Stamford, Conn.

[21] Appl. No.: 807,858

[22] Filed: Jun. 20, 1977

[51] Int. Cl.[2] ..... B65H 29/54

[52] U.S. Cl. ..... 271/174; 271/DIG. 2

[58] Field of Search ..... 271/DIG. 2, 80, 174; 118/60, 245; 432/60

[56] References Cited

U.S. PATENT DOCUMENTS

| | | | |
|---|---|---|---|
| 3,804,401 | 4/1974 | Stange | 271/80 |
| 3,837,640 | 9/1974 | Norton | 271/174 |
| 3,891,206 | 6/1975 | Bar-on | 271/174 |

*Primary Examiner*—Richard A. Schacher

*Attorney, Agent, or Firm*—J. J. Ralabate; C. A. Green; H. Fleischer

[57] ABSTRACT

An apparatus in which a stripping member separates a sheet adhering to a moving member. The stripping member is translatable so as to maintain the spacing between the moving member and the surface of the stripping member opposed therefrom substantially constant.

12 Claims, 3 Drawing Figures

SHEET STRIPPING APPARATUS

The foregoing abstract is neither intended to define the invention disclosed in the specification, nor is it intended to be limiting as to the scope of the invention in any way.

BACKGROUND OF THE INVENTION

This invention relates generally to an electrophotographic printing machine, and more particularly concerns an apparatus for separating copy sheets having a toner powder image transferred thereto from a moving photoconductive surface.

In the process of electrophotographic printing, a charged photoconductive member is exposed to a light image of an original document being reproduced. The irradiated areas of the photoconductive surface are discharged to record thereon an electrostatic latent image corresponding to the informational areas contained within the original document. A development system moves a developer mix of carrier granules and toner particles into contact with the photoconductive surface. The toner particles are attracted electrostatically from the carrier granules to the latent image forming a toner powder image thereon. Thereafter, the toner powder image is transferred to a sheet of support material. After transferring the toner powder image to the sheet of support material, a fusing device permanently affixes the toner powder image thereto.

Generally, during the transfer process, the sheet of support material is placed in contact with the toner powder image on the photoconductive surface and the backside of the sheet subjected to a spray of ionized air. This results in a charge being formed on the sheet having a magnitude and polarity sufficient to electrostatically attract the toner particles thereto. However, during transfer, a charge opposite to the charge found in the non-image areas of the photoconductive surface is induced on the sheet of support material. This causes the sheet to become electrostatically tacked to the photoconductive surface. The removal of the sheet of support material from the photoconductive surface has long been a problem in electrophotographic printing. Mechanical and pneumatic stripping devices have been used for quite some time in the printing art with varying degrees of success. However, devices of this type frequently suffer from misalignment problems. When the stripping mechanism is misaligned, it fails to act upon the sheet of support material either at the proper time or at the proper place. The sheet of support material may then remain on the photoconductive surface, i.e. it is not stripped, or the toner powder image is marred. In the case of a mechanical stripper wherein the pick off fingers are interposed between the photoconductive surface and the sheet of support material, misalignment of the fingers may produce abrasion or scratches on the photoconductive surface necessitating replacement thereof. Any of these malfunctions can seriously impair the reliability of the printing machine involving a great deal of lost machine time and, in the extreme case, result in permanent damage to the machine components. To this end, devices have been developed for floating the stripper finger on a cushion of air. This requires that the stripping fingers be spaced at a substantially constant distance from the photoconductive surface. However, a rotating photoconductive drum frequently has run-out. Run-out causes variations in the spacing between the stripping member and the photoconductive surface. To overcome this problem, the stripping finger has to be mounted movably. Previously the stripper finger has been mounted pivotably. However, a pivotably mounted stripper has an additional problem. The sensing portion of the stripping member is located at a different point than the tip of the stripping member. Thus, as the sensing portion detects drum run-out and moves accordingly to maintain the spacing constant, the tip of the finger moves a greater angular distance. This results in the tip of the stripping member being spaced too far from the photoconductive surface. The stripping member is then no longer interposed between the sheet of support material and photoconductive surface. This prevents separation of the sheet of support material and results in mis-strips.

Accordingly, it is a primary object of the present invention to improve the sheet stripping apparatus employed in an electrophotographic printing machine.

PRIOR ART STATEMENT

Various types of devices have hereinbefore been developed to improve the sheet stripping system. The following prior art appears to be relevant:

Stange, U.S. Pat. No. 3,804,401, 4/16/74

Norton et al., U.S. Pat. No. 3,837,640, 9/24/74

Bar-on, U.S. Pat. No. 3,891,206, 6/24/75

The pertinent portions of the foregoing prior art may be briefly summarized as follows:

Stange discloses a stripping member formed with a wedge portion positioned adjacent to the drum surface to affect stripping of the paper from the drum surface. The stripping member is supported by a gimballed spring which holds the wedge shaped member against the photoconductive surface. A manifold is connected to an air supply which furnishes low pressure air to the stripping head. This forms an air cushion at the bottom of the stripping head creating a floating stripping head. The action of the spring is opposed to the action of the air pressure. In this manner, the stripping head pivots so as to conform to irregularities in the drum surface.

Norton et al. describes a stripping finger supported on an air cushion. The air cushion supports the stripping finger at a uniform distance from the drum surface due to the action of springs. The springs urge the stripper finger upwardly into contact with the drum surface. Movement of the finger normal to the drum is effected by pivoting. The tip portion of the stripping finger member extends slightly beyond the point of tangency of the drum surface. In this manner, the tip strips the leading edge of the sheet from the drum surface.

Bar-on describes an automatically positionable sheet stripping finger which removes individual sheets from a moving photosensitive plate. The stripping finger is supported upon a pivotable arm provided with a pneumatic sensing nozzle. The nozzle senses variations in the pressure between the stripping finger and photosensitive surface. The nozzle, in turn, is connected to an amplifier which is arranged to control the positioning of the lever arm in response to the back pressure developed at the nozzle. As the stripper finger moves toward or away from the photoconductive surface, the back pressure changes thus causing the amplifier to move the lever arm in a direction so as to restore the stripping finger to the desired sheet stripping position.

It is believed that the scope of the present application, as defined by the appended claims, is patentably distinguishable over the foregoing prior art taken either singly or in combination with one another.

SUMMARY OF THE INVENTION

Briefly stated, and in accordance with the present invention, there is provided an apparatus for separating a sheet of support material having at least a portion thereof adhering removably to a moving member.

Pursuant to the features of the invention, a stripping member, spaced from the moving member, is arranged to be interposed between the sheet and moving member. Means are provided for detecting the spacing between the surface of said stripping member opposed to the moving member and the moving member. Means, responsive to the detecting means, translate the stripping member. This maintains the surface of the stripping member opposed to the moving member spaced a substantially constant distance therefrom.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
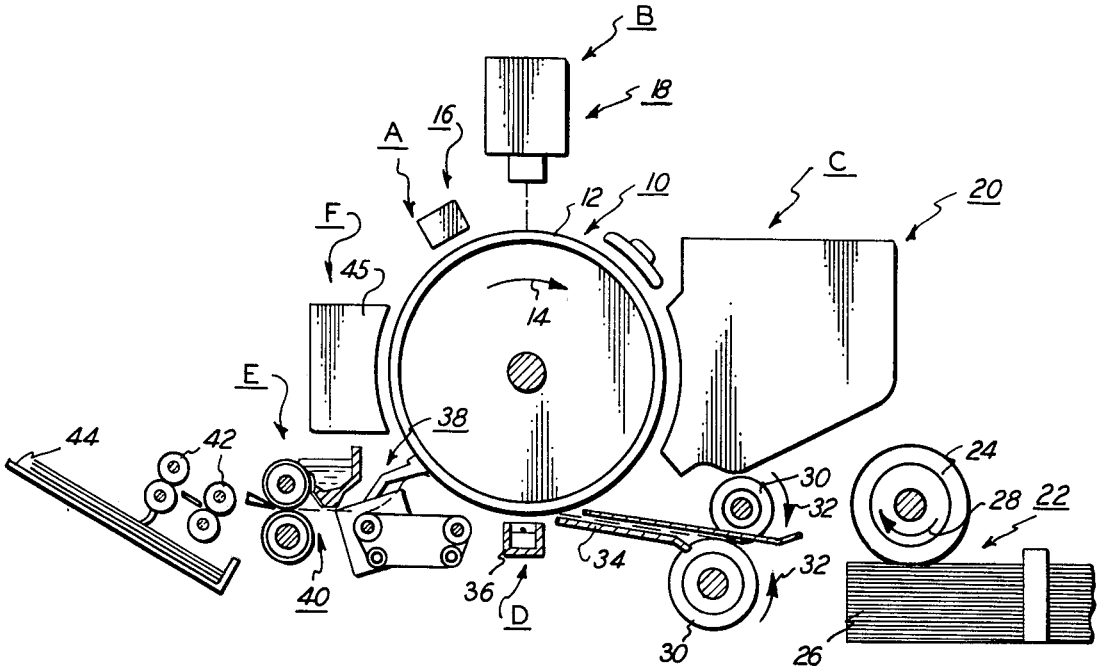
FIG. 1 depicts a schematic elevational view of an electrophotographic printing machine incorporating the features of the present invention therein.

For a general understanding of an electrophotographic printing machine in which the features of the present invention may be incorporated, reference is had to FIG. 1 which depicts schematically the various components thereof. Hereinafter, like reference numerals will be employed throughout to designate identical elements. Although the apparatus for separating a sheet of support material from the photoconductive surface after transferring the toner powder image thereto is particularly well adapted for use in electrophotographic printing, it should become evident from the following discussion that it is equally well suited for use in a wide variety of devices and is not necessarily limited in its application to the particular embodiment shown herein.

Inasmuch as the practice of electrophotographic printing is well known in the art, the various processing stations for producing a copy of an original document are represented in FIG. 1 schematically. Each processing station will be discussed briefly hereinafter.

As in all electrophotographic systems of the type illustrated, a drum 10 having photoconductive surface 12 entrained about and secured to the exterior circumferential surface of a conductive substrate is rotated, in the direction of arrow 14, through the various processing stations. One type of suitable photoconductive material is described in U.S. Pat. No. 2,970,906 issued to Bixby in 1961. Preferably, the conductive substrate is made from aluminum.

Initially, drum 10 rotates a portion of photoconductive surface 12 through charging station A. Preferably, charging station A utilizes a corona generating device, indicated generally by the reference numeral 16, to sensitize photoconductive surface 12. Corona generating device 16 is positioned closely adjacent to photoconductive surface 12. When energized, corona generating device 16 charges at least a portion of photoconductive surface 12 to a relatively high substantially uniform potential. For example, corona generating device 16 may be of the type described in U.S. Pat. No. 2,836,725 issued to Vyverberg in 1958.

Thereafter, drum 10 rotates the charged portion of photoconductive surface 12 to exposure station B. Exposure station B includes an exposure mechanism, indicated generally by the reference numeral 18, having a stationary, transparent platen, such as a glass platen or the like, for supporting an original document thereon. Scan lamps illuminate the original document. Scanning of the original document may be achieved by oscillating a mirror in a timed relationship with the movement of drum 10. This mirror is positioned beneath the platen to reflect the light image of the original document through a lens onto a mirror, which, in turn, transmits the light image through an apertured slit onto the charged portion of photoconductive surface 12. Irradiating the charged portion of photoconductive surface 12 selectively discharges the charge thereon to record an electrostatic latent image corresponding to the informational areas contained within the original document.

Drum 10 next rotates the electrostatic latent image recorded on photoconductive surface 12 to development station C. Development station C includes a developer unit, indicated generally by the reference numeral 20, having a housing with a supply of developer mix contained therein. The developer mix comprises carrier granules having toner particles adhering triboelectrically thereto. The carrier granules are preferably formed from a magnetic material with the toner particles being formed from a heat-settable plastic. Preferably, developer unit 20 is a magnetic brush development system. In a system of this type, the developer mix is brought through a directional flux field to form a brush thereof. The electrostatic latent image recorded on photoconductive surface 12 is developed by bringing the brush of developer mix into contact therewith. In this manner, the toner particles are attracted electrostatically to the latent image forming a toner powder image on photoconductive surface 12.

With continued reference to FIG. 1, a sheet of support material is advanced by sheet feeding apparatus 22 to transfer station D. Sheet feeding apparatus 22 includes a feed roll 24 contacting the uppermost sheet of the stack of sheets of support material 26. Feed roll 24 rotates in the direction of arrow 28 so as to advance the uppermost sheet from stack 26. Registration rollers 30, rotating in the direction of arrow 32, align and forward the advancing sheet of support material into chute 34. Chute 34 directs the advancing sheet of support material into contact with drum 10 in a timed sequence so that the toner powder image developed thereon contacts the advancing sheet of support material at transfer station D.

At transfer station D, corona generating device 36 applies a spray of ions to the backside of the sheet of support material. This attracts the toner powder image from photoconductive surface 12 to the sheet of support material. However, in addition, it frequently tacks the sheet of support material to drum 10. Thus, during the step of transfer, the sheet of support material becomes electrostatically tacked to drum 10. At this point, it must be separated from drum 10. This is achieved by sheet stripping apparatus 38. Sheet stripping apparatus 35 will be described hereinafter more fully with reference to FIGS. 2 and 3.

After transferring the toner powder image to the sheet of support material and separating the sheet of support material from drum 10, the sheet of support material is advanced to a fusing station E. Fusing station E includes a fuser assembly, indicated generally by the reference numeral 40. Fuser assembly 40 permanently affixes the transferred toner powder image to the sheet of support material. After the toner powder image is permanently affixed to the sheet of support material, the sheet of support material is advanced by a series of rollers 42 to catch tray 44 for subsequent removal therefrom by the machine operator.

Invariably, after the sheet of support material is stripped from photoconductive surface 12 of drum 10, some residual toner particles remain adhering to photoconductive surface 12. These residual toner particles are removed from photoconductive surface 12 at cleaning station F. Cleaning station F includes a cleaning system, indicated generally by the reference numeral 45. Initially, toner particles are brought under the influence of the cleaning systems corona generating device. The corona generating device neutralizes the remaining electrostatic charge on photoconductive surface 12 and that of the residual toner particles. The neutralized toner particles are cleaned from photoconductive surface 12 by a rotatably mounted fibrous brush in contact therewith. Subsequent to cleaning, a discharge lamp floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts sheet stripping apparatus 38 in greater detail.

Figure 2:
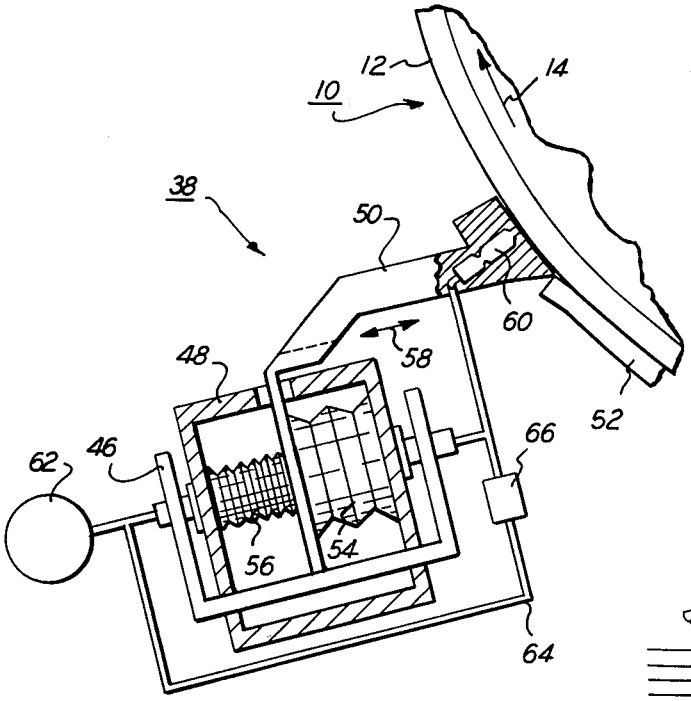
FIG. 2 illustrates a schematic elevational view of the sheet stripping apparatus employed in the FIG. 1 printing machine.

As shown in FIG. 2, stripping assembly 38 is connected to the machine frame 48 and comprises a support member 46 having stripping member 50 mounted thereon. Stripping member member 50 serves to separate a sheet of support material 52 from photoconductive surface 12 of drum 10. Stripping member 50 is rigidly connected at one end portion thereof to support member 46. Support member 46 is mounted slidably in frame 48. A pair of bellows 54 and 56 couple support member 46 to frame 48. When bellows 54 expands, bellows 56 contracts and stripping member 50 moves away from photoconductive surface 12. Contrawise, when bellows 56 expands, bellows 54 contracts and stripping member 50 moves toward photoconductive surface 12. Thus, the movement of bellows 54 and 56 control the movement of stripping member 50 so that it translates in the direction of arrow 58.

A sensing nozzle 60 is provided within the relatively wider main body of stripping member 50 with the nozzle orifice facing photoconductive surface 12 just above the sheet pick-off region. The nozzle is connected to a compressor 62 via line 64. Line 64 is also connected to bellows 54 and 56. The mass flow rate of air or a gas is controlled by nozzle 60 and the spacing of the lowermost portion or surface of stripping member 50 from photoconductive surface 12. As drum 10 rotates, the run-out thereof causes the spacing between photoconductive surface 12 and the lowermost portion of stripping finger 50 to vary. As this distance increases, the flow of air causes a pressure drop across restrictor 66 and reduces the pressure in nozzle 60. This decrease in pressure reduces the air pressure in bellows 54 causing bellows 56 to expand. This contracts bellows 54 moving stripping member 50 toward photoconductive surface 12 so as to maintain the spacing between photoconductive surface 12 and the lowermost surface of stripping member 50 substantially constant. Contrawise, if the distance between the lowermost portion of stripping member 50 and photoconductive surface 12 decreases, the pressure in bellows 54 increases causing it to expand and bellows 56 to contract. This results in stripping member 50 moving away from photoconductive surface 12. Stripping member 50 moves sufficiently to return the lowermost portion thereof to nearly the original position, i.e. a pre-determined distance or spacing from photoconductive surface 12. In this manner, the spacing between the lowermost portion of stripping member 50 and photoconductive surface 12 is maintained substantially constant. It should be noted that the pressure in bellows 56 remains substantially constant while the pressure in bellows 54 is variable depending upon the spacing between the lowermost portion of stripping member 50 and photoconductive 12. Restrictor 66 isolates bellows 56 and insures that only bellows 54 is affected by the change in spacing between photoconductive surface 12 and the lowermost portion of stripping member 50. Compresser 62 furnishes air at a pressure preferably of about 15 psi and at a flow rate preferably of about 0.03 cubic feet per minute. Thus, movement of stripping member 50 from the nominal position toward or away from photoconductive surface 12 causes the pressure in nozzle 60 to vary. This, in turn, increases or decreases the pressure within bellows 54. Inasmuch as the pressure within bellows 56 remains substantially constant, the change in pressure in bellows 54 slides support member 48 in frame 46 so as to balance the spring forces exerted by bellows 54 and 56. In this way, the spacing between photoconductive surface 12 and the lowermost portion of stripping finger 50 is substantially constant when the forces of bellows 54 and 56 are in balance with one another.

In operation, stripping member 50 is positioned at a pre-selected distance from photoconductive surface 12 with a range of about one-half the thickness of the sheet of support material. The air flow rate from nozzle 60 provides a differential pressure across restrictor 66 so a fet force difference between bellows 54 and 56 produces a translating or sliding action of support member 46 in frame 48 until that the bellows forces are again in equalibrium with one another. The desire for the bellows to always return to an equalibrium situation urges the stripping member in the direction of arrow 58 to maintain the spacing between the lowermost portion thereof and photoconductive surface 12 substantially constant. The tip portion of stripping member 50 is located substantially on the point of tangency of photoconductive surface 12. In this manner, the tip strips the leading edge of the sheet of support material 52 from photoconductive surface 12.

It will be appreciated that the stripping member does not contact photoconductive surface 12 during the stripping operation, but is held therefrom at a pre-selected distance within a pre-determined error band. In this manner, stripping member 50 will not damage or otherwise abrade photoconductive surface 12.

Figure 3:
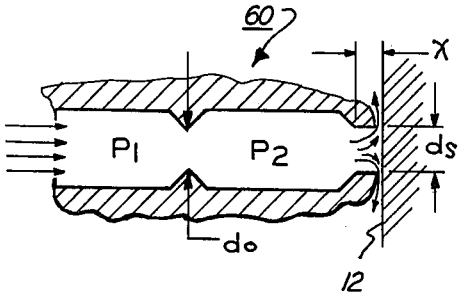
FIG. 3 shows a fragmentary sectional elevational view of the nozzle used in the FIG. 2 sheet stripping apparatus.

Turning now to FIG. 3, there is shown the detailed structure of nozzle 60. As depicted therein, the spacing between lowermost portion of stripping member 50 and photoconductive surface 12 is designated by X. As X increases, the air flow causes a pressure drop across $d_0$ and reduces the pressure $P_2$ in the control chamber of nozzle 60. The pressure $P_2$ in nozzle 60 corresponds to the pressure in bellows 54. Contrawise, the pressure $P_1$ in nozzle 60 corresponds to the pressure in bellows 56 and remains substantially constant. The decrease in pressure $P_2$ reduces the upward force exerted by bellows 54. Inasmuch as the force exerted by bellows 56 is now greater than the bellows force exerted by bellows 54, support member 46 translates in a downwardly direction moving stripping finger 50 toward photoconductive surface 12. This decreased the air flow rate and increases the pressure $P_2$ and restores bellows 54 and bellows 56 to an equalibrium condition. This back and forth motion of photoconductive surface 12 due to the run-out of drum 10 varies the pressure $P_2$ translating stripping member 50 in the direction of arrow 58. In this manner, stripping member 50 continuously translates as drum 10 rotates so as to maintain the spacing between the lowermost portion of stripping member 50 and photoconductive surface 12 substantially constant.

As has hereinbefore been shown, this stripping system provides a self-regulating arrangement which will continually position the lowermost portion of stripping member 50 at a substantially constant distance relative to photoconductive surface 12 regardless of drum run-out of other eccentricities that may be established between the two coacting surfaces. The movement of the tip of stripping member 50 is identical to the movement of nozzle 60. This is due to the translation rather than the pivotable movement of stripping member 50. Thus, the required change in distance sensed by nozzle 60 is the actual movement of the tip of stripping member 50. In this way, the spacing between the tip of stripping member 50 and photoconductive surface 12 is identical to the spacing between nozzle 60 and photoconductive surface 12. This eliminates the tip position error due to a pivoting movement rather than a translating movement.

In recapitulation, it is apparent that pursuant to the features of the present invention, as heretofore described, the stripping apparatus translates so as to maintain the lowermost portion thereof at a pre-selected substantially constant distance from photoconductive surface 12. The movement of the tip of the stripping member, which actually performs the stripping action, and the sensing portion is substantially identical. The foregoing is achieved by a pair of bellows coacting with one another to translate the stripping member relative to photoconductive surface 12. This type of an arrangement prevents any errors or misstrips in the system due to the tip of the stripping member moving a greater or lesser distance than the sensing or nozzle portion.

It is, therefore, evident that there has been provided, in accordance with the present invention, an apparatus for separating sheets of support material electrostatically tacked to a photoconductive surface. The apparatus of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for separating a sheet having at least a portion thereof adhering removably to a moving member, including:

a stripping member spaced from the moving member and arranged to be interposed between the sheet and moving member;

means for detecting the spacing between the surface of said stripping member opposed to the moving member and the moving member; and means, responsive to said detecting means, for translating said stripping member to maintain the surface of said stripping member opposed to the moving member spaced a substantially constant distance therefrom.

2. An apparatus as recited in claim 1, wherein said stripping member includes a passageway terminating in an aperture located in the surface of said stripping member opposed to the moving member.

3. An apparatus as recited in claim 2, wherein said detecting means includes means for supplying a pressurized gas through the passageway in said stripping member with variations in the spacing between the aperture in the surface of said stripping member and the moving member causing changes in the gas pressure within the passageway in said stripping member.

4. An apparatus as recited in claim 3, wherein said translating means includes pneumatic means operatively coupled to the passageway in said stripping member so that changes in the gas pressure within the passageway cause said pneumatic means to translate said stripping member maintaining the spacing between the moving member and said stripping member substantially constant.

5. An apparatus as recited in claim 4, wherein said pneumatic means includes a pair of bellows having said stripping member interposed therebetween so that changes in the gas pressure cause said pair of bellows to cooperate with one another moving said stripping member to maintain the spacing between said moving member and said stripping member substantially constant.

6. An apparatus as recited in claim 5, wherein said translating means includes a frame having said stripping member mounted slidably therein and supporting said pair of bellows substantially stationarily.

7. An electrophotographic printing machine of the type having at least a portion of a sheet of support material adhering removably to a photoconductive member, wherein the improvement includes:

a stripping member spaced from the photoconductive member and arranged to be interposed between the sheet of support material and the photoconductive member;

means for detecting the spacing between the surface of said stripping member opposed to the photoconductive member and the photoconductive member; and means, responsive to said detecting means, for translating said stripping member to maintain the surface of said stripping member opposed to the photoconductive member spaced a substantially constant distance therefrom.

8. A printing machine as recited in claim 7, wherein said stripping member includes a passageway terminating in an aperture located in the surface of said stripping member opposed to the photoconductive member.

9. A printing machine as recited in claim 8, wherein said detecting means includes means for supplying a pressurized gas through the passageway in said stripping member with variations in the spacing between the aperture in the surface of said stripping member and the photoconductive member causing changes in the gas pressure within the passageway in said stripping member.

10. A printing machine as recited in claim 9, wherein said translating means includes pneumatic means operatively coupled to the passageway in said stripping member so that changes in the gas pressure within the passageway cause said pneumatic means to translate said stripping member maintaining the spacing between the photoconductive member and said stripping member substantially constant.

11. A printing machine as recited in claim 10, wherein said pneumatic means includes a pair of bellows having said stripping member interposed therebetween so that changes in the gas pressure cause said pair of bellows to cooperate with one another moving said stripping member to maintain the spacing between the photoconductive member and said stripping member substantially constant.

12. A printing machine as recited in claim 11, wherein said translating means includes a frame having said stripping member mounted slidably thereon and supporting said pair of bellows substantially stationarily.

* * * * *